United States Patent [19]

Valasek

[11] Patent Number: 4,874,108

[45] Date of Patent: Oct. 17, 1989

[54] SEALER FOR CONTAINERS

[75] Inventor: Raymond J. Valasek, Newberg, Oreg.

[73] Assignee: Chromatic Paint Corporation, Stoney Point, N.Y.

[21] Appl. No.: 266,647

[22] Filed: Nov. 3, 1988

[51] Int. Cl.[4] ..... B65D 25/10

[52] U.S. Cl. ..... 220/93

[58] Field of Search ..... 220/93; 215/231

[56] References Cited

U.S. PATENT DOCUMENTS

| | | | |
|---|---|---|---|
| 1,155,447 | 10/1915 | Saunders | 220/93 |
| 2,828,886 | 4/1958 | Thomas | 220/93 |
| 3,164,289 | 1/1965 | Cocchiarella | 220/93 |
| 4,312,459 | 1/1982 | Leach | 220/93 X |
| 4,416,387 | 11/1983 | D'Antonio | 220/93 |
| 4,682,705 | 7/1987 | Hurwitz | 220/93 |
| 4,723,674 | 2/1988 | Nunes | 220/93 X |

*Primary Examiner*—Steven M. Pollard

*Attorney, Agent, or Firm*—Elliot M. Olstein; Raymond J. Lillie

[57] ABSTRACT

A sealing means for use with a container, which, in one embodiment, comprises a sealing portion and a handle attached to the sealing portion. The sealing portion is capable of covering a surface of a substance within a container so as to prevent the formation of a skin on the surface of the substance. In a preferred embodiment, the sealing portion comprises a flexible membrane or diaphragm with an O-ring at the circumference of the diaphragm. The O-ring is in sealing engagement with the interior wall of the container. The handle portion may also be made of a flexible material and comprise a shaft portion and at least one tab portion extending from the shaft portion. Alternatively, there may be a loop attached to the handle portion. The sealing means may thus be able to fit entirely within a container and need not be fastened to the container. In an alternative embodiment, there is provided a sealing means comprising a flexible membrane which has an area which does not exceed the interior cross-sectional area of the container.

14 Claims, 3 Drawing Sheets

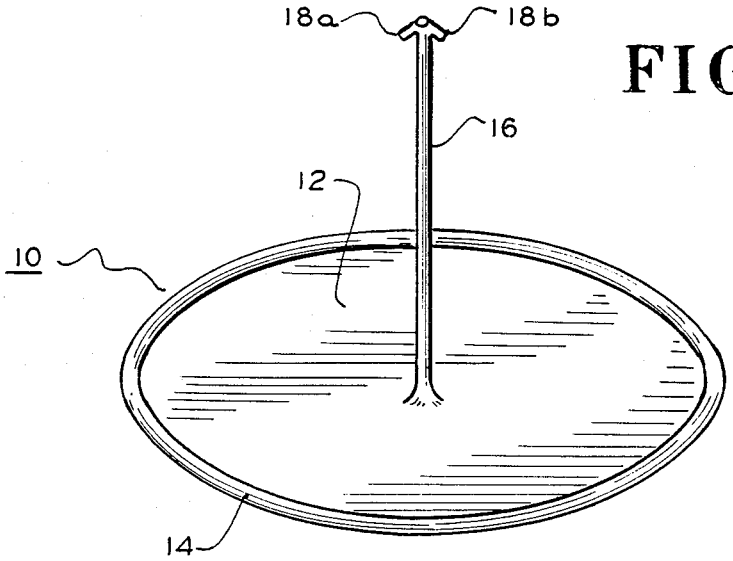
FIG. 1
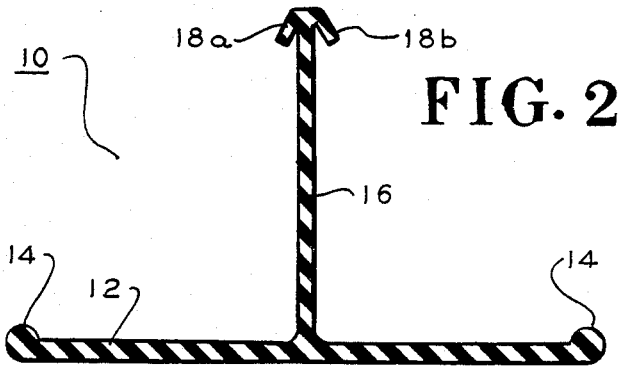
FIG. 2
FIG. 4
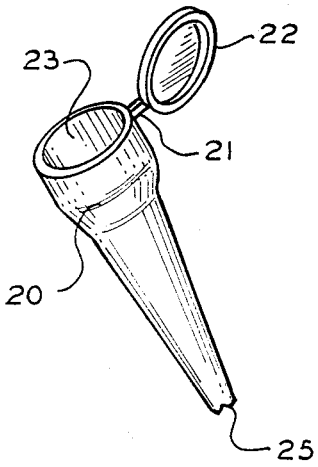
FIG. 3
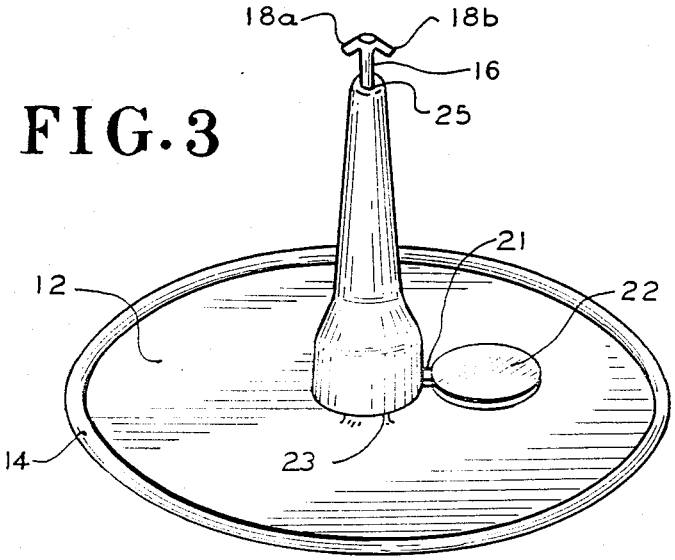

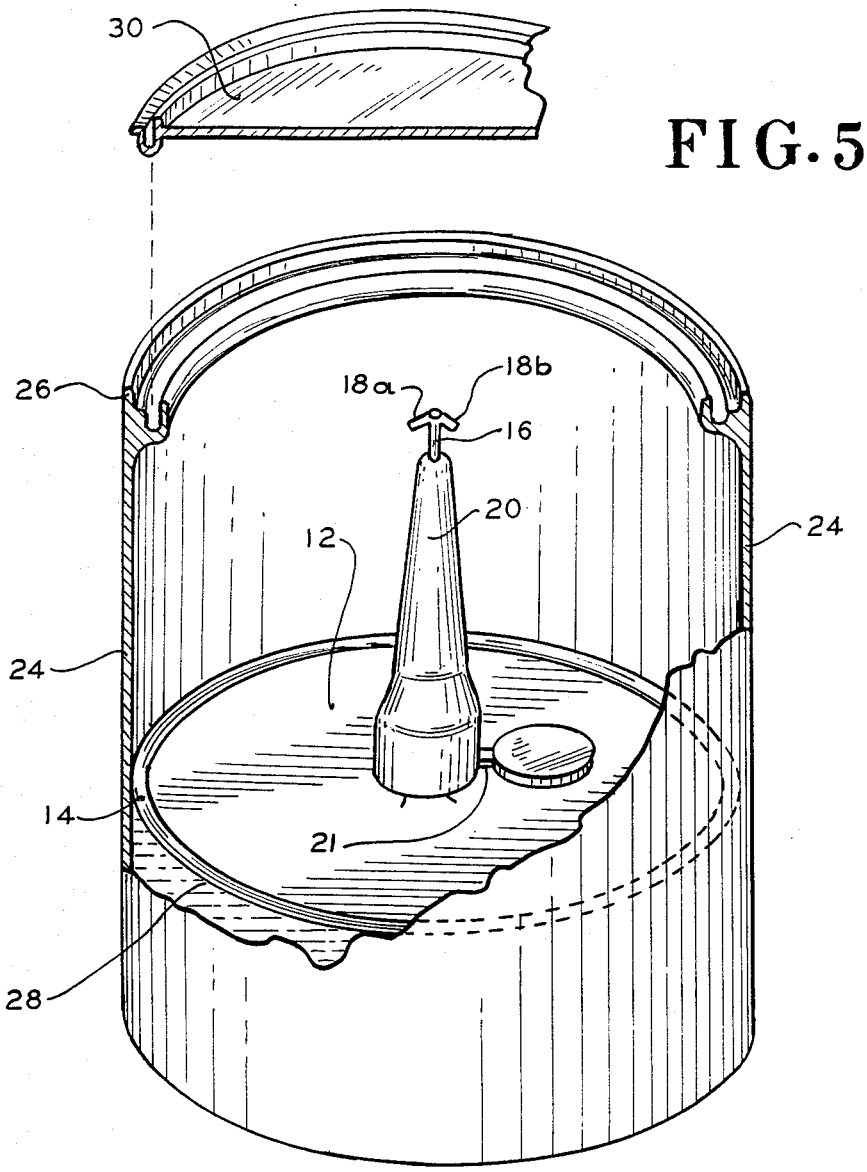
FIG. 5
FIG. 9
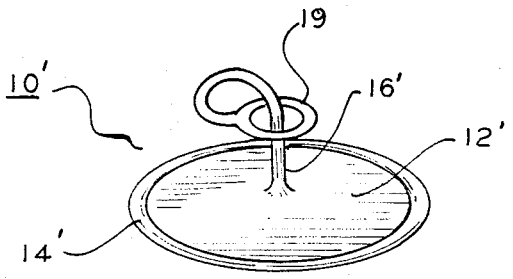
FIG. 10
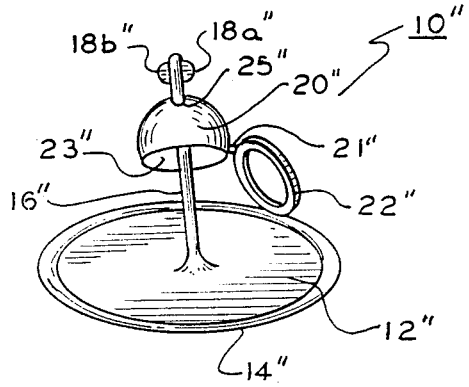

SEALER FOR CONTAINERS

This invention relates to a sealing means for use with a container. More particularly, this invention relates to a sealing means which prevents the formation of a skin on the surface of a substance within a container.

Substances such as paints, printing inks, suspensions, emulsions, mixtures of components of high and lower vapor pressures, and certain solutions, tend to form a skin on the surface of the substance when stored in a closed container. The skin is formed on the surface of the substance, where the surface of the substance has an interface with a gas pocket, within the container. The formation of the skin results in a reduction of the amount of usable product within the container. In many cases, a skin may be difficult to remove from or to redisperse within the substance. If small pieces of the skin find their way into the substance upon breaking of the skin, these pieces may hinder a proper application of the substance.

Also, dust sometimes may come to rest on the skin, if the container is left open for a long period of time without a cover. When one attempts to remove the skin, the dust may become mixed with the substance, thus contaminating the substance.

When substances such as paints, printing inks, and varnishes are used, the lighter components of the paints, printing inks, and varnishes rise to the top of the paint, printing ink, or varnish and form a skin if the paint, printing ink, or varnish is exposed to air for an extended length of time. Thus, when one removes the skin, there remains a liquid paint, printing ink, or varnish which does not contain the optimal amount of lighter components.

U.S. Pat. No. 2,751,073, issued to Sheeran, discloses a diaphragm which is floatable upon the upper surface of a liquid within a shipping drum. The diaphragm extends over the lip of the drum, and a cover holds the outer portion of the diaphragm against the lip of the drum. The diaphragm prevents contact between liquid and gas, and prevents volatilization of volatile liquids or emulsions such as aqueous emulsions of polyvinyl acetate.

In accordance with an aspect of the present invention, Applicant's invention is a sealing means for use with a container. The container has an interior wall portion and an exterior wall portion. The sealing means comprises a sealing portion which has a cross-sectional area at least that of the interior cross-sectional area of the container. The sealing portion is capable of covering the surface of a substance within the container, and includes a perimeter portion which is sealingly engageable with the interior wall portion of the container. Preferably, the sealing means is movable with said container, upon placing of the sealing means within the container, by virtue of the perimeter portion of the sealing portion being movable against the interior wall portion of the container. The sealing means also comprises a handle portion attached to the sealing portion. The handle portion may comprise a shaft portion attached to the sealing portion and at least one tab portion extending outwardly from the shaft portion.

In a preferred embodiment, the sealing portion comprises a flexible membrane, or diaphragm. The perimeter portion may include a reinforcing portion. In a most preferred embodiment, the membrane is circular in shape, and the reinforcing portion comprises an O-ring.

The handle portion of the sealing means may be made of a bendable material. In one alternative embodiment, there may also be included a loop attached to the bendable handle. In a preferred embodiment, the sealer may be configured such that the sealing portion is retractable within the loop.

The sealing means, in another embodiment, may further comprise a tube which has a length less than that of the handle portion. The tube surrounds at least the handle portion, and the sealing portion is retractable within the tube upon pulling of the handle portion. The sealing means may be expelled from the tube upon pushing of the handle portion. The tube may further include a cap. In a preferred embodiment, the tube includes a fluted wall portion to aid in the folding of sealing portion as it is retracted into the tube.

In accordance with another aspect of the present invention, there is provided a sealing means for use with a container as described above, which comprises a flexible membrane, such as a diaphragm. The membrane includes a perimeter portion which is sealingly engageable with the interior wall portion of the container. The membrane is capable of covering the surface of a substance within the container, but has a cross-sectional area which does not exceed the interior cross-sectional area of the container. In a preferred embodiment, the perimeter portion is movable against the interior wall portion of the container, thereby enabling the sealing means to be movable within the container upon insertion of the sealing means within the container. The sealing means may further include a reinforcing portion at the perimeter of the membrane or diaphragm. The sealing means may also further comprise a handle portion extending from the membrane. The handle portion may comprise a shaft portion and at least one tab portion as described above. The sealing means may also further comprise a tube and a cap for said tube as hereinabove described.

In accordance with another aspect of the present invention, there is provided a product comprising a container, said container having a wall portion which has an interior portion and an exterior portion. The container is capable of containing a substance. The product also comprises a sealing means, as described above, wherein the sealing means has a sealing portion capable of being in contact with and covering the surface of a substance. The sealing portion has a primeter portion in sealing engagement with the interior wall portion of the container. Preferably, the perimeter portion is movable against the interior wall portion of the container.

The present invention is also directed to a method of sealing a container by using a sealing means as described above. One seals the container by placing the perimeter portion of the sealing portion in sealing engagement with the interior wall portion of the container, and pushing downwardly upon the sealing portion until the sealing portion is in contact with the surface of the substance within the container. This protects the substance from contact with air and other materials external to the substance.

The invention will now be described with respect to the drawings, wherein:

FIG. 1 is a top isometric view of a first embodiment of the sealer in accordance with the present invention;

FIG. 2 is a cross-sectional view of the sealer shown in FIG. 1;

FIG. 3 is a top isometric view of the sealer, which depicts a tube for containing the sealer;

FIG. 4 is a side view of a tube for containing the sealer;

FIG. 5 is a break-away view depicting the sealer within a paint can, with the sealing portion of the sealer in contact with the surface of the paint;

FIG. 9 is a top isometric view of a second embodiment of the sealer in accordance with the present invention; and FIG. 10 is a top isometric view of a third embodiment of the sealer in accordance with the present invention.

Figure 6:
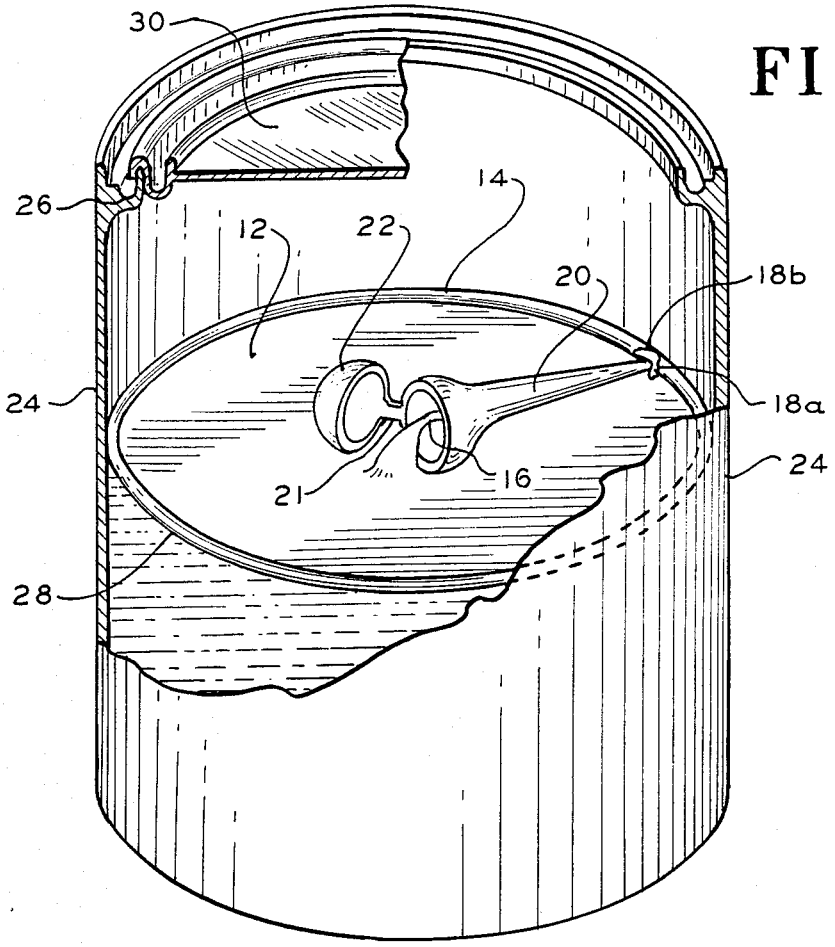
FIG. 6 is a break-away view of the sealer within a paint can wherein the sealing portion is in contact with the surface of the paint and the handle portion and tube are bent so as to lie on top of said sealing portion.

Referring now to the drawings, an embodiment of the sealer 10 comprises a sealing portion comprised of a flexible membrane or diaphragm 12. The diaphragm has a perimeter reinforcing portion in the form of an O-ring 14. Diaphragm 12 is capable of covering the surface of a substance within a container, and is made of a material that is impermeable to substances which the diaphragm 12 may cover. Diaphragm 12 in a most preferred embodiment, has a cross-sectional area the same as the interior cross-sectional area of the container with which it is used. O-ring 14 is capable of abutting against the wall of the container so that diaphragm 12 and O-ring 14 may provide an effective seal within the container against any gases or other materials within the container, thereby keeping the gases or other materials from coming into contact with the substance covered by diaphragm 12.

Attached to and extending upwardly from the central portion of diaphragm 12 is a handle portion comprised of a shaft 16 and tab portion 18*a* and 18*b* at the top of shaft 16. When inserting the sealer 10 into a container, one grips tabs 18*a* and 18*b* and pushes down upon shaft 16 until the diaphragm 12 touches and covers the substance within the container. When one wishes to remove the sealer 10 from a container, one grips tabs 18*a* and 18*b*, and pulls tabs 18*a* and 18*b*, as well as shaft 16 upward until the diaphragm 12 is removed from the container.

In a preferred embodiment, diaphragm 12, O-ring 14, shaft 16, and tabs 18*a* and 18*b* are made of a flexible or bendable material. The length of shaft 16 may vary, although in many cases it is preferred that the length of shaft 16 be slightly less than the diameter of diaphragm 12. Although diaphragm 12, O-ring 14, shaft 16, and tabs 18*a* and 18*b* are to be made, in a preferred embodiment, of flexible materials, it is most preferred that O-ring 14, shaft 16, and tabs 18*a* and 18*b* be more rigid than diaphragm 12. It is therefore most preferred that the sealer 10 be made of a material that can be molded so as to provide portions of varying flexibilities which will enable the sealer to conform to the inner contours of a container as well as to permit the diaphragm 12 to be squeezed, or wrung, so as to purge a substance from the underside of the diaphragm 12 when the sealer 10 is removed from a container. The shaft 16 should be flexible, or bendable such that shaft 16 and tabs 18*a* and 18*b* may fit entirely within a container when a lid or cover is placed on top of the container after sealer 10 is inserted. In many cases it is preferred that shaft 16 is bendable such that shaft 16 may rest upon diaphragm 12 after sealer 10 is inserted into a container. It is also contemplated that one may wish to compress the sealer 10 such that it may fit within a holder or container for storage when not in use. Therefore, it is desirable that sealer 10 be made of a material or materials that enable the sealer to be compressed for storage, yet enable the parts of sealer 10 to assume their normal shape for use in sealing a container. In a preferred embodiment, sealer 10 is made of a silicone rubber or flexible plastic material, or a combination of flexible materials (e.g., it is possible that diaphragm 12 and O-ring 14 be made of a different material than shaft 16).

The sealer 10 may be stored within a tube 20 having a cap 22. Cap 22 may be detachable from tube 20 or may be attached to tube 20 by means of hinge 21. Tube 20 and cap 22 are preferably molded from a flexible plastic or rubber material. Tube 20 and cap 22 may be of the same material as shaft 16 and/or diaphragm 12 and O-ring 14. Tube 20 also has two open ends 23 and 25, with opening 23 having a greater diameter than opening 25. One fits sealer 10 into tube 20 by inserting tabs 18*a* and 18*b* and shaft 16 into opening 23, and through tube 20. It can be seen that the length from the end of tab 18*a* to the end of tab 18*b* exceeds the diameter of opening 25. Tabs 18*a* and 18*b*, however, are bendable upon shaft 16 and are thus capable of passing through opening 25 as shaft 16 is pushed through tube 20, and resume their normal configuration, extending outwardly from shaft 16 upon being pushed through opening 25, thus extending outwardly over opening 25 as well. Tabs 18*a* and 18*b*, therefore, prevent the sealer from slipping out of tube 20.

Thus, it is seen that tube 20 always surrounds and contains shaft 16 of the handle portion of the sealer. When the sealer is used to seal a container, diaphragm 12 and O-ring 14 lie below opening 23 and cap 22 and are extended outwardly and radially so as to assume their normal shape. When the sealer is not being used, one pulls upon tabs 18*a* and 18*b* and shaft 16 so as to compress diaphragm 12, and to pull diaphragm 12 and O-ring 14 into tube 20. Cap 22 may then be placed over opening 23 so as to retain diaphragm 12 and O-ring 14 within tube 20. When one wishes to use diaphragm 12 and O-ring 14 to seal a container, one removes cap 22 from tube 20 and grips tabs 18*a* and 18*b*, and/or squeezes tube 20, and pushes down upon shaft 16 in order to expel diaphragm 12 and O-ring 14 from tube 20. Upon being expelled from tube 20, diaphragm 12 and O-ring 14 quickly assume their normal shape for sealing a container.

The operation of sealer 10 will now be described as it is used in sealing a paint can. It is to be understood, however, that the sealer 10 may be used to seal other types of containers holding other substances, and that the scope of the present invention is not to be limited to the following teaching.

Cap 22 is removed from tube 20 and diaphragm 12 and O-ring 14 are pushed out of opening 23 by gripping tabs 18*a* and 18*b*, and/or squeezing tube 20, and pushing down upon shaft 16. O-ring 14, which is located at the perimeter or circumference of diaphragm 12, has a diameter which is the same as that of the interior portion of the paint can. Diaphragm 12, therefore has a cross-sectional area that is equal to the interior cross-sectional area of the paint can. Diaphragm 12 and O-ring 14 are bent slightly so as to fit through the top opening of the paint can as defined by lip 26. When the diaphragm 12 and O-ring 14 are fitted through the top opening of the paint can, O-ring 14 abuts against the interior cylindrical wall 24 of the paint can so as to be in sealing engagement with cylindrical wall 24. One then continues to push downwardly upon shaft 16 and tube 20 until diaphragm 12 and O-ring 14 come into contact with the surface 28 of the paint. O-ring 14 continues to remain in contact with the interior cylindrical wall 24, as the diaphragm 12 and O-ring 14 are being moved downwardly. The center of diaphragm 12 is pushed slightly into the paint so as to allow any air between the surface 28 of the paint and the diaphragm 12 to escape. The sealer 10 thus has provided an effective separation of air, dust and other impurities from the paint. The shaft 16 and tube 20 may then be bent so as to lie on top of diaphragm 12 in order to accommodate the placing of a cover 30 or lid on the top of the paint can, or, alternatively, the sealer 10 may remain in the paint can without a cover being placed on top of the paint can.

When one wishes to remove sealer 10 from the paint can, one removes cover 30, if used, from the paint can. If shaft 16 and tube 20 were bent to accommodate the placing of cover 30 on top of the paint can, shaft 16 and tube 20 now return to their original shapes. After cover 30 is removed, one then grips tabs **18*a* and 18*b* and pulls upwardly upon shaft 16. This pulling causes the diaphragm 12 to be squeezed and compressed, and the seal between O-ring 14 and the wall 24 of the paint can to be broken. The diaphragm and O-ring are drawn into tube 20. As the diaphragm 12 is being withdrawn into tube 20, any paint which may be on the underside of diaphragm 12 is purged from diaphragm 12 and returned to the paint can, as the drawing of the diaphragm 12 into tube 20 has a squeezing or wringing effect upon diaphragm 12. Once diaphragm 12 and O-ring 14 are drawn into tube 20, cap 22 is placed over tube 20 and the sealer 10** may be stored for future use.

When tube 20 is not employed, one can squeeze diaphram 12 by hand after the seal 10 has been removed from the paint can so as to purge the diaphragm 12 of any paint which may be on the underside of diaphragm 12.

Figure 7:
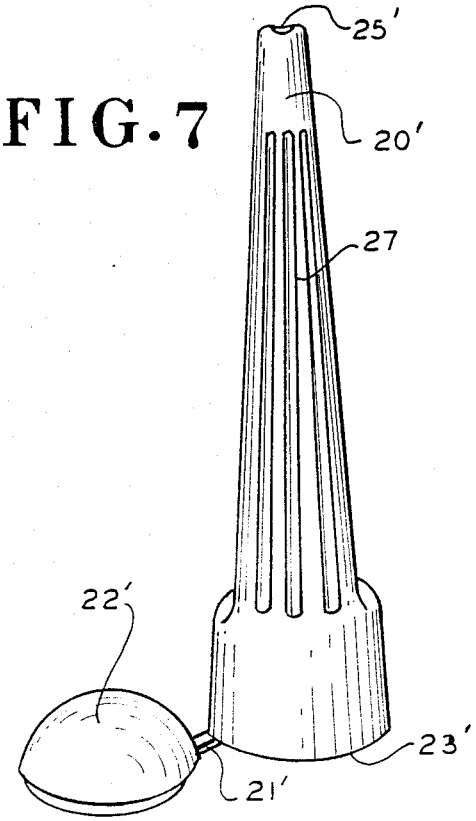
FIG. 7 is a side view of an alternative embodiment of a tube for containing the sealer as depicted in FIGS. 1 and 2.
Figure 8:
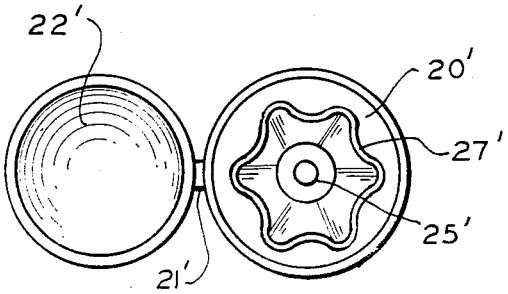
FIG. 8 is a top view of sid tube.

As shown in FIGS. 7 and 8, an alternative embodiment of tube 20' includes openings 23' and 25', cap 22, and hinge 21', which are analogous to openings 23 and 25, cap 22, and hinge 21 as described above. As a diaphragm and O-ring of a sealer are pulled through openings 23' into tube 20', fluted wall 27 enables the diaphragm to become evenly folded and also enables the diaphragm to purge the maximum amount of a substance from its underside. The even foldings of the diaphragm also serves to prevent permanent damage to and/or distortion of the diaphragm.

Alternative embodiments of the sealer in accordance with the present invention will now be described. It is to be understood the the scope of the invention is not intended to be limited to these embodiments.

One alternative, as shown is FIG. 9, depicts a sealer 10' having a diaphragm 12', an O-ring 14', and a handle portion comprised of a shaft 16', attached to one end to diaphragm 12', and having a loop 19 attached to the other end of the shaft 16'. Shaft 16' is flexible such that one can bend shaft 16' in order to position diaphragm 12' and O-ring 14' above loop 19. One then squeezes diaphragm 12' and O-ring 14' in order to pass diaphragm 12' and O-ring 14' through loop 19, after which diaphragm 12' and O-ring 14' return to their normal shape. When one wishes to purge the undersurface of diaphragm 12' of a substance, one grips shaft 16' and pulls upwardly on shaft 16' until diaphragm 12' and O-ring 14' are passed into loop 19, whereby the diaphragm 12' and O-ring 14' become squeezed or compressed, thereby purging the undersurface of diaphragm 12' of a substance.

Another embodiment, as shown in FIG. 10, discloses, a sealer 10'' comprised of a diaphragm 12'', an O-ring 14'', and a handle portion comprised of a shaft 16'' having tab portions **18*a*'' and 18*b*'' at the top of shaft 16. One end of shaft 16'' is attached to diaphragm 12''. The shaft 16'' passes through openings 23'' and 25'' of tube 20'', and tabs 18*a*'' and 18*b*'' project outwardly from the top of shaft 16''. The length across tabs 18*a*'' and 18*b*'' is greater than the diameter of opening 25''. Tube 20'' also includes cap 22'', which attached to tube 20'' by means of hinge 21.'' As hereinbefore described, one can pull upwardly upon shaft 16'' so as to remove diaphragm 12'' from a container, and/or squeeze and compress diaphragm 12'' and O-ring 14'' so as to fit diaphragm 12'' and O-ring 14'' within tube 20.'' As diaphragm 12'' and O-ring 14'' are pulled into tube 20'', any liquid which may have adhered to the undersurface of diaphragm 12'' is purged from the undersurface of diaphragm 12.''**

It is also contemplated that one may use a flexible membrane or diaphragm (not shown), without a handle portion, for sealing a container such as a paint can. The membrane or diaphragm may have a reinforcing portion, such as an O-ring, around its perimeter. The diaphragm would cover the surface of a substance, such as paint, within a container, and would have a cross-sectional area that would not exceed the interior cross-sectional area of the container. The diaphragm would be inserted into the container and placed upon the surface of the substance. The O-ring would be in sealing engagement with the interior wall of the container. When one wished to remove the diaphragm from the container, and would grip the top surface of the diaphragm by hand or by the use of tongs, for example, and pull the diaphragm out of the container. One then would purge the substance, such as paint, from the bottom surface of the diaphragm by gripping the top surface of the diaphragm and then squeezing or wringing the diaphragm.

Advantages of the present invention include the provision of a handle portion which is attached to a sealing portion which facilitates the insertion of the sealer into a container as well as the removal of the sealer from the container. The sealer may also include a diaphragm which fits entirely inside a container. Such a diaphragm does not extend over an upper rim or lip of a container and does not require a cover or fastening means to hold the diaphragm in place. The tube, when employed, enables one to draw the diaphragm and O-ring into the tube while purging the diaphragm of paint or other substances as the diaphragm is drawn into the tube by pulling the handle portion. The tube also provide a means for storing the sealer.

It is to be understood that the scope of the present invention is not to be limited to the specific embodiments described above. The invention may be practiced other than as particularly described and still be within the scope of the accompanying claims.

What is claimed is:

1. A sealing means for use with a container, said container including an interior wall portion, said sealing means comprising:

a sealing portion, said sealing portion having a cross-sectional area at least that of the interior cross-sectional area of said container, said sealing portion having a perimeter portion sealingly engageable with said interior wall portion of said container;

a handle portion attached to said sealing portion; and a tube, said tube having a length less than that of said handle portion, said tube surrounding at least said handle portion, and said sealing portion is retractable within said tube upon pulling of said handle portion.

2. The sealing means of claim 1 wherein said perimeter portion is movable against said interior wall portion of said container.

3. The sealing means of claim 1 wherein said handle portion comprises:

a shaft portion attached to said sealing portion; and at least one tab portion extending outwardly from said shaft portion.

4. The sealing means of claim 1 wherein said sealing portion comprises a flexible membrane.

5. The sealing means of claim 4 wherein said perimeter portion of said membrane includes a reinforcing portion.

6. The sealing means of claim 1 wherein said handle portion is made of a bendable material.

7. The sealing means of claim 1 and further comprising a cap for said tube.

8. The sealing means of claim 1 wherein said tube includes a fluted wall portion.

9. A product, comprising:

a container, said container having a wall portion, said wall portion having an interior portion and an exterior portion, said container capable of containing a substance; and a sealing means, said sealing means comprising a sealing portion, said sealing portion having a cross-sectional area at least that of the cross-sectional area of said container, said sealing portion capable of covering and being in contact with the surface of said substance within said container, said sealing portion having a perimeter portion sealingly engageable with said interior wall portion of said container, a handle portion attached to said sealing portion, and a tube, said tube having a length less than that of said handle portion, said tube surrounding at least said handle portion, and said sealing portion is retractable within said tube upon pulling of said handle portion.

10. The product of claim 9 wherein said perimeter portion is movable against the interior wall portion of said container.

11. The product of claim 9 wherein said handle portion comprises:

a shaft portion attached to said sealing portion; and at least one tab portion extending outwardly from said shaft portion.

12. The product of claim 9 wherein said sealing portion comprises a flexible membrane.

13. The product of claim 12 wherein said perimeter portion of said membrane includes a reinforcing portion.

14. The product of claim 9 wherein said handle portion is made of a bendable material.

* * * * *